United States Patent [19]

Hartline, III

[11] 4,217,150

[45] Aug. 12, 1980

[54] CORROSION RESISTANT AUSTENITIC STEEL

[75] Inventor: Albert G. Hartline, III, Brackenridge, Pa.

[73] Assignee: Allegheny Ludlum Steel Corporation, Pittsburgh, Pa.

[21] Appl. No.: 6,716

[22] Filed: Jan. 26, 1979

Related U.S. Application Data

[60] Continuation of Ser. No. 503,225, Sep. 5, 1974, abandoned, which is a division of Ser. No. 355,394, Apr. 30, 1973, Pat. No. 3,907,551.

[51] Int. Cl.[2] ..... C21D 7/14

[52] U.S. Cl. ..... 148/2; 148/12 E; 148/12.4; 148/14

[58] Field of Search ..... 148/2, 3, 12 E, 12.4 H, 148/14, 12; 75/125, 126

[56] References Cited

U.S. PATENT DOCUMENTS

| | | | |
|---|---|---|---|
| 2,745,740 | 5/1956 | Jackson et al. | 75/130.5 |
| 2,778,731 | 1/1957 | Carney | 75/126 B |
| 2,862,812 | 12/1958 | Dulis et al. | 75/125 |
| 2,909,425 | 10/1959 | Hsiao et al. | 75/126 B |
| 2,940,880 | 6/1960 | Stanley et al. | 148/16 |
| 3,854,938 | 12/1974 | Baybrook et al. | 75/128 A |
| 3,876,475 | 4/1975 | Ramquist | 75/126 B |

FOREIGN PATENT DOCUMENTS

| | | | |
|---|---|---|---|
| 778597 | 7/1957 | United Kingdom | 75/126 R |
| 892667 | 3/1962 | United Kingdom | 75/126 B |

*Primary Examiner*—M. J. Andrews

*Attorney, Agent, or Firm*—Vincent G. Gioia; Robert F. Dropkin

[57] ABSTRACT

A substantially non-porous, sulfuric acid resistant austenitic stainless steel and a method for making it are disclosed. The steel includes from 15–45% manganese, from 10–30% chromium, from 1–3% copper, from 0.85–3% nitrogen, from 0–2% silicon, from 0–1% carbon, and the balance iron and residuals. In addition to containing the foregoing elements within the above-noted composition ranges, the alloys must be such that:

$$\frac{30(\%C + \%N) + 0.5(\%Mn)}{\%Cr + 1.5(\%Si)} \geqq 1.5 \quad (1)$$

$$\%Cr + 0.8(\%Mn) - 11.88(\%N - 0.1) - (28.5 + \%Cu) \geqq 0 \quad (2)$$

The steels are cast and worked to avoid a dwell period in the temperature range 1000–1600° F.

2 Claims, 1 Drawing Figure

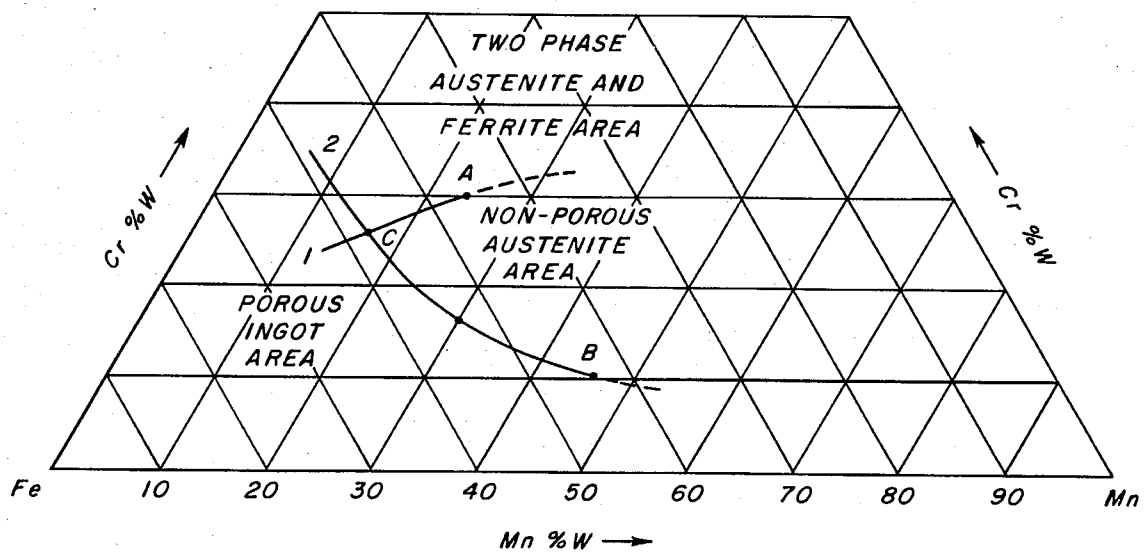
Cr % W
Cr % W
Mn % W
Fe
Mn
10
20
30
40
50
60
70
80
90
TWO PHASE AUSTENITE AND FERRITE AREA
NON-POROUS AUSTENITE AREA
POROUS INGOT AREA
A
B
C
1
2

CORROSION RESISTANT AUSTENITIC STEEL

This is a continuation of application Ser. No. 503,225, filed Sept. 5, 1974, now abandoned, which is a division of application Ser. No. 355,394 filed Apr. 30, 1973 now U.S. Pat. No. 3,907,551 issued Sept. 23, 1975.

BACKGROUND OF THE INVENTION

Corrosion resistant steels known as stainless steels have long been known and are presently available with a variety of properties. Austenitic stainless steels, which are those consisting substantially of a single austenite phase, possess the best properties of corrosion resistance and good mechanical properties, particularly at high temperature.

Austenitic stainless steels in the past have been steels in which chromium and nickel are the principal alloying agents. However, nickel is not an abundant metal and the increased demand for it has increased its price and made its supply uncertain, particularly in critical times. Substitutes for nickel in the chromium-nickel austenitic stainless steels have long been sought. Recently the combined use of manganese and nitrogen along with chromium in carefully limited ratios has produced an austenitic stainless steel. In that steel, at least 0.85% nitrogen is required to produce the austenitic structure but large amounts of nitrogen cause the steel ingot to be porous. Accordingly, it has been found that the nitrogen content of such a steel must be limited to less than 3%. Throughout the specification and claims all references to percent in composition shall be percent by weight of the total composition.

The manganese in the above-noted steel must be present in amounts of from 15–45%. Manganese is necessary to increase the solubility of nitrogen in steel, in addition to itself contributing to the austenitic structure.

Although the chromium-manganese-nitrogen stainless steel is an excellant austenitic stainless steel, it has been found to be subject to attack by sulfuric acid to a significant extent and accordingly its use is limited to those environments where sulfuric acid is not present.

SUMMARY OF THE INVENTION

The present invention is a chromium-manganese-copper-nitrogen alloy that is non-porous, austenitic, and highly resistant to attack by sulfuric acid. The alloy of this invention contains from 15–45% manganese, from 10–30% chromium, from 1–3% copper, from 0.85–3% nitrogen, from 0–2% silicon, from 0–1% carbon, and the balance iron and residuals. Residuals are impurities in the iron that are not deliberately added to the alloy and have no significant detrimental effect in the alloy.

In addition to the foregoing ranges, the composition of the alloys must be balanced in accordance with the following equations:

$$\frac{30(\%C + \%N) + 0.5(\%Mn)}{\%Cr + 1.5(\%Si)} \geqq 1.5 \quad (1)$$

$$\%Cr + 0.8(\%Mn) - 11.88(\%N - 0.1) - (28.5 + \%Cu) \geqq 0 \quad (2)$$

In the alloys of the present invention, chromium must be present to produce the same effect that it does in prior art alloys. The alloys of this invention must contain from 10–30% chromium. At least 10% chromium is required to give the steel its outstanding corrosion resistance. Chromium also has a secondary effect upon the strength of the steel and is a primary element in increasing the steel's solubility for nitrogen. When more than 30% chromium is present in the alloy, a ferrite phase is formed which degrades the mechanical properties of the steel and accordingly more than 30% chromium should not be present. A preferred chromium content is in the range from 15–27% in that steels containing this range of chromium are easy to process while still having good corrosion resistance and strength.

The manganese in the alloy of this invention is present in amounts of from 15–45%. Since manganese increases the solubility of nitrogen in the steel, amounts in excess of 15% are required, preferably at least 21%. Manganese in excess of 45% produces no further beneficial effect and should be avoided as wasteful and because large quantities of manganese in an alloy tend to attack furnace refractories.

Nitrogen is a strong austenitizer and should be present in the steel in amounts from 0.85–3%. At least 0.85% is required to provide the austenitic structure of the steel while amounts of nitrogen in excess of 3% tend to yield porous ingots which are not satisfactory. The nitrogen content of the alloy of this invention preferably is from 1.05–1.5%.

The copper content of the alloy of this invention must be between 1–3%. Although copper has been known as an alloy additive to increase resistance to sulfuric acid attack, it has in the past been used in nickel-containing alloys and in large amounts. The copper of previously known acid-resistant alloys has caused a sacrifice in other properties. In the present invention relatively little copper is effective to produce the sulfuric acid resistant alloy, and the alloys of this invention have substantially the same mechanical properties as their counterparts containing no copper or only residual amounts. In fact, alloys of this invention containing up to 1.5% copper have been found to be hot-workable so that they may be rolled, forged or otherwise shaped and their properties altered for specific uses that could not be readily obtained in the as-cast condition.

Carbon, of course, is a well-known austenitizer and strengthener for steels and is employed in the alloys of this invention in amounts up to 1%. The concentration of carbon must be maintained below that level in that larger amounts remove chromium from the solid solution by forming chromium carbide, which requires higher annealing temperatures to dissolve the carbide. It is preferred that less than 0.15% carbon be present in the alloy of this invention.

The alloys of the present invention may tolerate silicon concentrations as high as 2% but preferably the silicon is below 1%. Higher quantities of silicon tend to remove manganese from the alloy in the form of manganese silicates and tend to form inclusions in the steel.

Although the residuals in the iron need not be identified and do not significantly affect the properties of the alloy, the usual residuals may be identified as molybdenum, phosphorus, sulfur, tungsten, cobalt and nickel.

Since the stainless steel composition of this invention is desirably a substantially one-phase austenitic material, thermal treatments that tend to precipitate other phases should be avoided. Although the alloys of this invention are not particularly sensitive to precipitation of other phases, the method of preparation employed should avoid long dwell periods in the 1000–1600° F. temperature range. Long dwell periods would be characterized by furnace cooling. Air cooling or quenching are sufficient to carry the alloy through the 1000–1600° F. range for ordinary thicknesses quickly enough to avoid precipitation of detrimental phases such as sigma phase.

DETAILED DESCRIPTION OF THE INVENTION

The accompanying drawing is a plot of the 1.0% nitrogen section of the iron-chromium-manganese-nitrogen quaternary phase diagram of an alloy that also contains 1% copper.

Copper does not have a significant effect on austenitic structure and accordingly doesn't appear as a factor in equation (1) set forth above, which defines the line 1-A of the drawing. The area above line 1-A generally represents compositions where a two-phase alloy of austenite and ferrite exist. As mentioned above, this two-phase system is undesirable because it does not have the good mechanical or chemical properties of a single phase austenitic alloy. The area below line 1-A is a single phase austenitic alloy.

Equation (2) defines the line 2-B. The area below the line 2-B represents compositions where nitrogen comes out of solution during solidification and creates porous ingots. The area above line 2-B is where nitrogen remains in solution during solidification and non-porous ingots are formed.

The area A-C-B therefore represents the area in which the alloys of this invention fall for this particular cross section of the quaternary phase diagram. Lines 1-A and 2-B are the best lines to represent mildly scattered data obtained from analysis of 26 heats which included a significant number in the porous ingot zone, in the two-phase austenite-ferrite zone and in the one-phase non-porous austenite zone.

To demonstrate the benefits of this invention, four alloys were prepared having compositions set forth in Table One.

TABLE ONE

| ELEMENT | ALLOY (% BY WEIGHT) 1 | 2 | 3 | 4 |
|---|---|---|---|---|
| Mn | 30.40 | 30.00 | 30.10 | 30.00 |
| Cr | 20.45 | 20.25 | 20.38 | 20.34 |
| Cu | 0.20 | 0.96 | 2.00 | 2.98 |
| N | 1.00 | 1.08 | 1.09 | 1.04 |
| Si | 0.48 | 0.52 | 0.50 | 0.51 |
| C | 0.092 | 0.062 | 0.062 | 0.063 |
| Fe plus residuals | Balance | Balance | Balance | Balance |

Alloy 1 is not an alloy in accordance with this invention because its copper content is substantially below 1% and in fact is at the residual level. All other alloys are within the scope of this invention containing nominally 1%, 2% and 3% copper.

All heats were melted in an air induction furnace and cast to ingot form without the occurrence of ingot porosity. Microscopic examination of specimens from each ingot revealed that all had austenitic structure. Alloys 3 and 4 showed some segregation of copper at interdendritic regions. When alloys 3 and 4 were hot rolled, they cracked in the manner of hot shortness.

Ingots of alloys 1 and 2 were hot rolled, annealed at 1950° F. for a period of 60 minutes per inch of cross section thickness, were then cold rolled to a 50% thickness reduction and finally annealed again at 1950° F. for a period of 60 minutes per inch of thickness. The annealed strips were never furnace cooled in order to bring them through the 1000–1600° F. temperature range slowly and as a result the finally rolled, annealed strips were austenitic. The strips were cleaned by the usual techniques, a number of specimens taken from each and their properties measured. The mechanical properties of alloys 1 and 2 are set forth in Table Two.

TABLE TWO

| PROPERTIES | ALLOY 1 | ALLOY 2 |
|---|---|---|
| Tensile strength as annealed | | |
| 0.2% yield strength (KSI) | | |
| longitudinal | 97.5–99.2 | 108.3–108.9 |
| transverse | 98.2–100.5 | 111.4–111.6 |
| Ultimate tensile strength (KSI) | | |
| longitudinal | 146.1–146.4 | 152.8–152.9 |
| transverse | 147.7–149.2 | 156.0–157.3 |
| Elongation (%) | | |
| longitudinal | 50–52 | 44–46 |
| transverse | 45–50 | 44.5–46 |
| Hardness (Rockwell) | 28 | 31 |
| Tensile strength after cold reduction of annealed strip | | |
| 10% reduction | | |
| 0.2% yield strength (KSI) | | |
| longitudinal | 158.2–162.0 | 121.9–126.9 |
| transverse | 151.4–151.8 | 119.6–119.9 |
| Ultimate tensile strength (KSI) | | |
| longitudinal | 186.6–187.9 | 163.6–163.7 |
| transverse | 184.7–191.2 | 163.0–163.1 |
| Elongation (%) | | |
| longitudinal | 28–30 | 36–38 |
| transverse | 27.5–30 | 37.5–38 |
| Hardness (Rockwell) | 40 | 36.5 |
| 25% reduction | | |
| 0.2% yield strength (KSI) | | |
| longitudinal | 201.9–204.4 | 191.9–192.6 |
| transverse | 193.0–194.8 | 183.3–183.8 |
| Ultimate tensile strength (KSI) | | |
| longitudinal | 218.8–219.4 | 215.9–217.0 |
| transverse | 222.4–224.2 | 215.4–218.8 |
| Elongation (%) | | |
| longitudinal | 18–19.5 | 18 |
| transverse | 13–15.5 | 16 |
| Hardness (Rockwell) | 46 | 45.5 |
| 50% reduction | | |
| 0.2% yield strength (KSI) | | |
| longitudinal | 256.5–263.8 | 254.0–256.5 |
| transverse | 246.7–250.3 | 224.6–226.1 |
| Ultimate tensile strength (KSI) | | |
| longitudinal | 275.3–283.8 | 276.6–277.0 |
| transverse | 288.6–289.6 | 262.7–264.6 |
| Elongation (%) | | |
| longitudinal | 7–7.5 | 3–4 |
| transverse | 8.0 | 7.5–8.0 |
| Hardness (Rockwell) | 49.8 | 49.5 |
| Strain Hardening Exponent | 0.36 | 0.36 |

From the data in Table Two it is evident that alloys of this invention with a copper content of 1% are capable of being worked. It is also evident that the presence of copper in the alloy has no significant effect on the mechanical properties of the worked alloy.

Specimens of alloy 1 and 2 were subjected to standard corrosion testing to measure their resistance to sulfuric acid. Resistance of an alloy to sulfuric acid is measured by exposing an alloy specimen in sulfuric acid and obtaining both the anodic polarization data and the cathodic polarization data and determining their intersection point on the same plot of voltage versus current. A correlation is known to exist between the intersection points of these lines and the resistance of the specimen to sulfuric acid corrosion. Intersection of these lines at lower current flows indicates better resistance to sulfuric acid.

Table Three contains data obtained in the foregoing test on specimens of alloy 1 and alloy 2. The resistance to sulfuric acid corrosion was measured at three different sulfuric acid concentrations, namely, 1.0 normal, 5.0 normal and 10 normal.

TABLE THREE

| | ALLOY 1 | ALLOY 2 |
|---|---|---|
| Anodic-cathodic polarization | | |
| 1.0 N $H_2SO_4$ intersection at (milliamp/cm$^2$) | 5.0 | .012 |
| 5.0 N $H_2SO_4$ intersection at (milliamp/cm$^2$) | 9.0 | .012 |
| 10.0 N $H_2SO_4$ intersection at (milliamp/cm$^2$) | — | 1.50 |

Table Three indicates that an alloy of this invention with a minimum copper concentration, 1%, has significantly greater resistance to sulfuric acid than the prior art alloys containing only residual amounts of copper. The two order of magnitude difference in intersection points represents a very significant difference in susceptibility to sulfuric acid corrosion. The intersection point of alloy 1 was not measured in the 10 normal sulfuric acid solution because the current at which the intersection occurred would be too large to be meaningful.

When subjected to tests to measure susceptibility of the alloys to chloride pitting, it was found that both alloy 1 and alloy 2 have high resistance to chloride pitting and are about equivalent in this regard.

Alloys 3 and 4 are more resistant to attack by sulfuric acid or to attack by chlorides than alloy 2.

What is claimed is:

1. A method for producing a substantially non-porous austenitic stainless steel which comprises the steps of preparing a melt consisting essentially of, by weight, 21–45% manganese, 10–30% chromium, 1–3% copper, 0.85–3% nitrogen, 0–1% carbon, 0–2% silicon and the balance iron and residuals wherein the composition is such that $$\frac{30(\%C + \%N) + 0.5(\%Mn)}{\%Cr + 1.5(\%Si)} \geqq 1.5 \quad (1)$$

$$\%Cr + 0.8(\%Mn) - 11.88(\%N - 0.1) - (28.5 + \%Cu) \geqq 0; \quad (2)$$

casting said melt; and air cooling or quenching the casting in the temperature range of from 1600° F. to 1000° F.

2. The method of claim 1 wherein said melt contains from 1–1.5% copper, wherein the casting is hot worked and annealed at a temperature higher than 1600° F., and wherein the hot worked alloy is air cooled or quenched in the temperature range of from 1600° F. to 1000° F.

* * * * *